US009738960B2

(12) United States Patent
Kizu et al.

(10) Patent No.: US 9,738,960 B2
(45) Date of Patent: Aug. 22, 2017

(54) HIGH STRENGTH STEEL SHEET

(71) Applicant: JFE Steel Corporation, Tokyo (JP)

(72) Inventors: Taro Kizu, Kawasaki (JP); Yoshimasa Funakawa, Fukuyama (JP); Hidekazu Ookubo, Chiba (JP); Tokunori Kanemura, Chiba (JP); Masato Shigemi, Chiba (JP); Shoji Kasai, Kawasaki (JP); Shinji Yamazaki, Kawasaki (JP); Yusuke Yasufuku, Kawasaki (JP)

(73) Assignee: JFE Steel Corporation (JP)

( * ) Notice: Subject to any disclaimer, the term of this patent is extended or adjusted under 35 U.S.C. 154(b) by 253 days.

(21) Appl. No.: 14/396,924

(22) PCT Filed: Apr. 18, 2013

(86) PCT No.: PCT/JP2013/002638

§ 371 (c)(1),
(2) Date: Oct. 24, 2014

(87) PCT Pub. No.: WO2013/161231

PCT Pub. Date: Oct. 31, 2013

(65) Prior Publication Data

US 2015/0056468 A1 Feb. 26, 2015

(30) Foreign Application Priority Data

Apr. 24, 2012 (JP) ..... 2012-098548

(51) Int. Cl.
*C22C 38/02* (2006.01)
*C22C 38/04* (2006.01)
(Continued)

(52) U.S. Cl.
CPC ..... *C22C 38/60* (2013.01); *C21D 8/0263* (2013.01); *C21D 8/0284* (2013.01);
(Continued)

(58) Field of Classification Search
None
See application file for complete search history.

(56) References Cited

U.S. PATENT DOCUMENTS

2009/0010793 A1 1/2009 Becker et al.
2013/0133790 A1* 5/2013 Ariga ..... C21D 8/0226 148/602
2013/0192725 A1* 8/2013 Funakawa ..... C21D 1/673 148/537

FOREIGN PATENT DOCUMENTS

CN 1809646 7/2006
CN 101264681 9/2008
(Continued)

OTHER PUBLICATIONS

Machine-English translation of JP2006-022349, Yoshinaga Naoki et al., Jan. 26, 2006.*

(Continued)

*Primary Examiner* — Deborah Yee
(74) *Attorney, Agent, or Firm* — DLA Piper LLP (US)

(57) ABSTRACT

The high strength steel sheet has a chemical composition including 0.08% to 0.20% of C, 0.3% or less of Si, 0.1% to 3.0% of Mn, 0.10% or less of P, 0.030% or less of S, 0.10% or less of Al, 0.010% or less of N, 0.20% to 0.80% of V, and the remainder composed of Fe and incidental impurities on a percent by mass basis, and a microstructure which includes 95% or more of ferrite phase on an area percentage basis, in which fine precipitates are dispersed having a distribution in such a way that the number density of precipitates having a particle size of less than 10 nm is $1.0\times10^5/\mu m^3$ or more and the standard deviation of natural logarithm values of precipitate particle sizes with respect to precipitates having a particle size of less than 10 nm is 1.5 or less.

3 Claims, 2 Drawing Sheets

(51) Int. Cl.

| | |
|---|---|
| ***C22C 38/06*** | (2006.01) |
| ***C22C 38/12*** | (2006.01) |
| ***C22C 38/14*** | (2006.01) |
| ***C22C 38/60*** | (2006.01) |
| ***C21D 9/46*** | (2006.01) |
| ***C22C 38/00*** | (2006.01) |
| ***C21D 8/04*** | (2006.01) |
| ***C21D 8/02*** | (2006.01) |
| ***C22C 38/08*** | (2006.01) |
| ***C22C 38/16*** | (2006.01) |
| ***C22C 38/24*** | (2006.01) |
| ***C22C 38/28*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C23C 2/02*** | (2006.01) |
| ***C23C 2/06*** | (2006.01) |

(52) U.S. Cl.

CPC ..... *C21D 8/0463* (2013.01); *C21D 8/0478* (2013.01); *C21D 9/46* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/24* (2013.01); *C22C 38/28* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C23C 2/02* (2013.01); *C23C 2/06* (2013.01); *C21D 2211/004* (2013.01); *C21D 2211/005* (2013.01); *Y10T 428/12799* (2015.01)

(56) References Cited

FOREIGN PATENT DOCUMENTS

| | | |
|---|---|---|
| EP | 2 554 706 | 2/2013 |
| JP | 2006-161112 | 6/2006 |
| JP | 2008-174805 | 7/2008 |
| JP | 2008-240116 | 10/2008 |
| JP | 4464748 | 2/2010 |
| JP | 2011-219826 | 11/2011 |
| WO | 2006/048034 | 5/2006 |
| WO | 2011/122031 | 10/2011 |

OTHER PUBLICATIONS

Supplementary European Search Report dated Sep. 10, 2015 of corresponding European Application No. 13782226.8.

Chinese Office Action dated Jun. 15, 2016, of corresponding Chinese Application No. 201380021909.9, along with a Concise Statement of Relevance of Office Action in English.

* cited by examiner

HIGH STRENGTH STEEL SHEET

TECHNICAL FIELD

This disclosure relates to a high strength steel sheet suitable for framework members, e.g., pillars and members of automobiles, reinforcing members, e.g., door impact beams of automobiles, and structural members of, e.g., automatic vending machines, desks, household electrical appliance, OA equipments, and construction materials. In particular, the disclosure relates to an improvement in shape fixability of a high strength steel sheet. In this regard, the term "high strength" refers to a yield strength YP of 1,000 MPa or more. Also, the yield strength of the high strength steel sheet is preferably 1,100 MPa or more, and more preferably 1,150 MPa or more.

BACKGROUND

In recent years, reduction in the amount of carbon dioxide $CO_2$ output has been desired ardently from the viewpoint of global environmental conservation. In particular, in the automobile field, reduction in the weight of a car body has been required strongly to enhance fuel economy and reduce the amount of $CO_2$ output. Such circumstances are the same in the use of a steel sheet, and demands for reduction in the usage of a steel sheet which exhibits a large amount of $CO_2$ output in production of the steel sheet have increased.

In particular, as for a structural member, where deformation of a part should be avoided, reduction in thickness through enhancement of the yield strength of a steel sheet is effective from the viewpoint of reduction in the usage (mass) of the steel sheet. However, if the yield strength of the steel sheet is enhanced, there is a problem that shape defects occur because of springback or the like in press forming. When shape defects occur, it is necessary that a press forming step be further added to correct the shape by press forming into a predetermined shape. The shape correction increases the production cost and, in addition, particularly in high strength steel sheets having a yield strength of 1,000 MPa or more, it may become impossible to correct the shape up to a predetermined shape. Consequently, the impossibility of improving the shape fixability of the high strength steel sheet becomes a hindrance to an achievement of reduction in thickness of the high strength steel sheet.

Then, a ferrite phase which is soft, easy to press form, and advantageous to ensure the shape and a martensite phase which is hard and advantageous to enhance the strength are combined and, thereby, a dual-phase steel sheet has been developed as a high strength steel sheet having good shape fixability and a high tensile strength in combination. However, although that technology can enhance tensile strength, there is a problem that the yield strength is reduced because of the presence of the soft ferrite phase. To enhance the yield strength of the above-described dual-phase steel sheet, it is necessary that the microstructure has a very high percentage of martensite phase. But, as for the dual-phase steel sheet having such a microstructure, a new problem is induced in that cracking occurs during press forming.

For example, Japanese Patent No. 4464748 describes a high strength steel sheet having excellent shape fixability and stretch flangeability as the high strength steel sheet having improved shape fixability. The high strength steel sheet described in Japanese Patent No. 4464748 has a chemical composition containing C: 0.02% to 0.15%, Si: more than 0.5% and 1.6% or less, Mn: 0.01% to 3.0%, Al: 2.0% or less, Ti: 0.054% to 0.4%, and B: 0.0002% to 0.0070% and further containing at least one of Nb: 0.4% or less and Mo: 1.0% or less on a percent by mass basis. Also, the high strength steel sheet described in Japanese Patent No. 4464748 has a microstructure in which the greater part of phase is ferrite or bainite, and a texture in which an average value of X-ray random intensity ratios of {001}<110> to {223}<110> orientation groups of a sheet face at the position one-half the sheet thickness is 6.0 or more, and an X-ray random intensity ratio of at least one of the {112}<110> orientation and the {001}<110> orientation among these orientation groups is 8.0 or more. Also, the high strength steel sheet described in Japanese Patent No. 4464748 has a microstructure in which the number of compound precipitates having a particle size of 15 nm or less is more than or equal to 60% of the total number of the compound precipitates, and at least one of the r value in the rolling direction and the r value in the direction at a right angle to the rolling direction is 0.8 or less. It is mentioned that according to Japanese Patent No. 4464748, a steel sheet having highly improved shape fixability and excellent hole expansion property is obtained by adjusting the precipitates and the texture at the same time.

Meanwhile, Japanese Unexamined Patent Application Publication No. 2008-174805 describes a high yield strength hot rolled steel sheet. The hot rolled steel sheet described in Japanese Unexamined Patent Application Publication No. 2008-174805 has a chemical composition containing C: more than 0.06% and 0.24% or less, Mn: 0.5% to 2.0%, Mo: 0.05% to 0.5%, Ti: 0.03% to 0.2%, V: more than 0.15% and 1.2% or less, and Co: 0.0010% to 0.0050% on a percent by mass basis. Then, the hot rolled steel sheet described in Japanese Unexamined Patent Application Publication No. 2008-174805 has a microstructure which is substantially a ferrite single phase and in which complex carbides containing Ti, Mo, and V and carbides containing V only are dispersed, where the total of the amount of Ti precipitated as complex carbides containing Ti, Mo, and V and the amount of V precipitated as carbides containing V only is more than 0.1000% and less than 0.4000% on a percent by mass basis. Also, the hot rolled steel sheet described in Japanese Unexamined Patent Application Publication No. 2008-174805 has a high yield strength of 1,000 MPa or more. It is mentioned Japanese Unexamined Patent Application Publication No. 2008-174805 that a high yield strength steel sheet having highly improved bending property after working and a yield strength of 1,000 MPa or more is obtained because a very small amount of Co is contained, substantially a ferrite single phase is present, and complex carbides containing Ti, Mo, and V and carbides containing V only are dispersed.

However, according to Japanese Patent No. 4464748, the compound (precipitate) particle size is large and the resulting yield strength is up to about 900 MPa. That is, according to Japanese Patent No. 4464748, it is difficult to further enhance the yield strength up to 1,000 MPa or more. Meanwhile, according to Japanese Unexamined Patent Application Publication No. 2008-174805, the bending property after working is improved, but the problem remains in that a predetermined shape fixability cannot be ensured.

It could therefore be helpful to provide a high strength steel sheet having a yield strength of 1,000 MPa or more and excellent shape fixability, and a method of manufacturing the same. In this regard, the yield strength YP of the high strength steel sheet should preferably be 1,100 MPa or more, and further preferably 1,150 MPa or more. Here, the thickness of the "steel sheet" is 2.0 mm or less, preferably 1.7 mm or less, more preferably 1.5 mm or less, and further preferably 1.3 mm or less.

SUMMARY

We thus provide:

(1) A high strength steel sheet characterized by having a chemical composition comprising C: 0.08% to 0.20%, Si: 0.3% or less, Mn: 0.1% to 3.0%, P: 0.10% or less, S: 0.030% or less, Al: 0.10% or less, N: 0.010% or less, V: 0.20% to 0.80%, and the remainder composed of Fe and incidental impurities on a percent by mass basis, a microstructure which includes 95% or more of ferrite phase on an area percentage basis, in which precipitates having a particle size of less than 10 nm are dispersed having a distribution in such a way that the number density is $1.0\times10^5/\mu m^3$ or more and the standard deviation of natural logarithm values of precipitate particle sizes with respect to precipitates having a particle size of less than 10 nm is 1.5 or less, and a yield strength of 1,000 MPa or more.

(2) The high strength steel sheet according to (1), characterized in that the above-described chemical composition further contains at least one group selected from the following Group A to Group F on a percent by mass basis; Group A: Ti: 0.005% to 0.20%, Group B: at least one selected from Nb: 0.005% to 0.50%, Mo: 0.005% to 0.50%, Ta: 0.005% to 0.50%, and W: 0.005% to 0.50%, Group C: B: 0.0002% to 0.0050%, Group D: at least one selected from Cr: 0.01% to 1.0%, Ni: 0.01% to 1.0%, and Cu: 0.01% to 1.0%, Group E: Sb: 0.005% to 0.050%, and Group F: at least one selected from Ca: 0.0005% to 0.01% and REM: 0.0005% to 0.01%.

(3) The high strength steel sheet according to (1) or (2), characterized in that a coating layer is disposed on the steel sheet surface.

(4) A method of manufacturing a high strength steel sheet, characterized by including the step of subjecting a steel having a chemical composition comprising C: 0.08% to 0.20%, Si: 0.3% or less, Mn: 0.1% to 3.0%, P: 0.10% or less, S: 0.030% or less, Al: 0.10% or less, N: 0.010% or less, V: 0.20% to 0.80%, and the remainder composed of Fe and incidental impurities on a percent by mass basis to a hot rolling process composed of heating, rough rolling, finish rolling, cooling and coiling into the shape of a coil at a predetermined coiling temperature, wherein the above-described heating is performed at a temperature of 1,100° C. or higher for 10 min or more, the above-described rough rolling is performed at a finish rough rolling temperature of 1,000° C. or higher, the above-described finish rolling is performed at a finishing temperature of 850° C. or more, in which the reduction ratio in a temperature range of 1,000° C. or lower is 96% or less, the reduction ratio in a temperature range of 950° C. or lower is 80% or less, the above-described cooling after completion of the finish rolling is performed at an average cooling rate of (30×[V])° C./s or more in relation to the V content [V] (percent by mass) in a temperature range from the finishing temperature to 750° C. and at an average cooling rate of (10×[V])° C./s or more in relation to the V content [V] (percent by mass) in a temperature range from 750° C. to the coiling temperature, and the above-described coiling temperature is specified to be 500° C. or higher and (700−50×[V])° C. or lower in relation to the V content [V] (percent by mass).

(5) The method of manufacturing a high strength steel sheet according to the item (4), characterized in that the above-described chemical composition further contains at least one group selected from the following Group A to Group F on a percent by mass basis; Group A: Ti: 0.005% to 0.20%, Group B: at least one selected from Nb: 0.005% to 0.50%, Mo: 0.005% to 0.50%, Ta: 0.005% to 0.50%, and W: 0.005% to 0.50%, Group C: B: 0.0002% to 0.0050%, Group D: at least one selected from Cr: 0.01% to 1.0%, Ni: 0.01% to 1.0%, and Cu: 0.01% to 1.0%, Group E: Sb: 0.005% to 0.050%, and Group F: at least one selected from Ca: 0.0005% to 0.01% and REM: 0.0005% to 0.01%.

(6) The method of manufacturing a high strength steel sheet according to (4) or (5), characterized in that in subjecting the hot rolled steel sheet to a coating annealing process composed of pickling and coating annealing treatment following the above-described hot rolling process, the above-described coating annealing treatment is performed by heating in a temperature range from 500° C. to a soaking temperature at an average heating rate of (5×[C])° C./s or more up to the soaking temperature of (800-200×[C])° C. or lower, in relation to the C content [C] (percent by mass), holding at the soaking temperature for a soaking time of 1,000 s or less, cooling to a zinc coating bath temperature of 420° C. to 500° C. at an average cooling rate of 1° C./s or more, and dipping into the zinc coating bath.

(7) The method of manufacturing a high strength steel sheet according to (6), characterized in that after the above-described coating annealing process is applied, a reheating treatment is further applied by reheating to a temperature range of 460° C. to 600° C. and holding at the reheating temperature for 1 s or more.

(8) The method of manufacturing a high strength steel sheet according to any one of (4) to (7), characterized in that after the above-described hot rolling process or the above-described coating annealing process, a tempering treatment is further applied by working at a thickness decrease ratio of 0.1% to 3.0%.

A high strength steel sheet having a yield strength of 1,000 MPa or more, excellent press formability, and shape fixability can be produced easily and stably. It can be said that this effect is an industrially remarkable.

DETAILED DESCRIPTION

Figure 1:
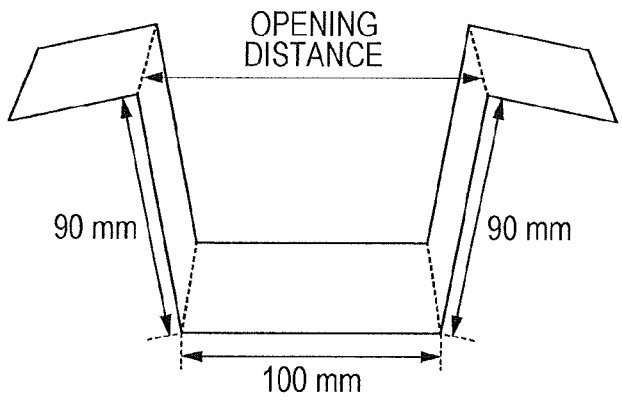
FIG. 1 is an explanatory diagram schematically showing a rough shape of a hat-shaped member used to evaluate shape fixability.

We performed intensive studies on various factors which exert influence on the shape fixability for the purpose of ensuring the compatibility between high yield strength and shape fixability. We found that ensuring high strength through dispersion of fine precipitates and, in addition, proper adjustment of the size distribution of the precipitates was necessary to produce a high strength steel sheet having excellent shape fixability.

This is because in the case of size distribution in which most of precipitates have large sizes, dislocations are concentrated around the large precipitates during press forming, interactions occur between dislocations, and movements of dislocations are hindered so that plastic deformation is suppressed. Consequently, we believe that the degree of dependence of deformation on elastic deformation increases, shape defect due to springback occurs easily, and the shape fixability is degraded. Then, we adjusted the size distribution of the precipitates to a specific size distribution in which small precipitates were increased was important to suppress concentration of dislocations during press forming and improve the shape fixability.

Our experimental results will be described below.

Various hot rolled steel sheets having a chemical composition containing C: 0.08% to 0.21%, Si: 0.01% to 0.30%, Mn: 0.1% to 3.1%, P: 0.01% to 0.1%, S: 0.001% to 0.030%, Al: 0.01% to 0.10%, N: 0.001% to 0.010%, V: 0.19% to 0.80%, and Ti: 0.005% to 0.20% on a percent by mass basis or further containing an appropriate amount of at least one of Cr, Ni, Cu, Nb, Mo, Ta, W, B, Sb, Cu, and REM were obtained under various hot rolling conditions. Test pieces were taken from these hot rolled steel sheets, and a microstructure observation, a tensile test, and a shape fixability test were performed.

Initially, in the microstructure observation, a test piece for the microstructure observation was taken from each of the hot rolled steel sheets, a cross-section in the rolling direction (L cross-section) was polished, and corrosion with nital was performed. An observation was performed with an optical microscope (magnification: 500 times) and the area percentage of ferrite phase was determined. We ascertained that a plurality of steel sheets having a microstructure in which the area percentage of ferrite phase was 95% or more were obtained.

Also, a thin film sample was taken from each of the hot rolled steel sheets, and the size of precipitates (particle size) and the number density thereof were measured by using a transmission electron microscope. The precipitate was not spherical and, therefore, a maximum particle size was taken as the size thereof (particle size).

Meanwhile, in the tensile test, a tensile test piece in conformity with JIS No. 5 was taken from each of the hot rolled steel sheets in such a way that the tensile direction was the direction at a right angle to the rolling direction (C direction). Subsequently, these test pieces were used, and the tensile test was performed in conformity with specifications of JIS Z 2241 to determine the yield strength (YP).

Also, in the shape fixability test, a test piece (size: 80 mm×360 mm) was taken from each of the hot rolled steel sheets, and press forming was performed, so as to produce a hat-shaped member as shown in FIG. 1. After the press forming, the opening distance was measured, as shown in FIG. 1, and the shape fixability was evaluated. In this regard, in the press forming, a blank holder pressure was specified to be 20 tons and the die shoulder radius R was specified to be 5 mm.

Figure 2:
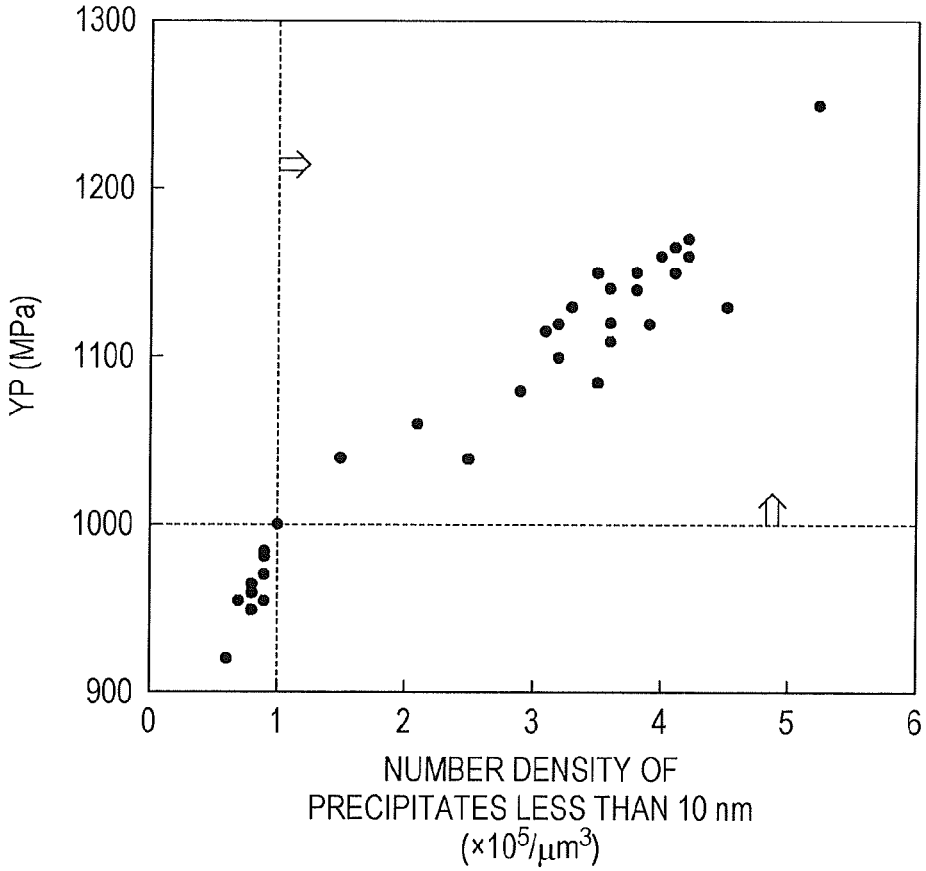
FIG. 2 is a graph showing the influence of the number density of precipitates less than 10 nm on the yield strength YP.
Figure 3:
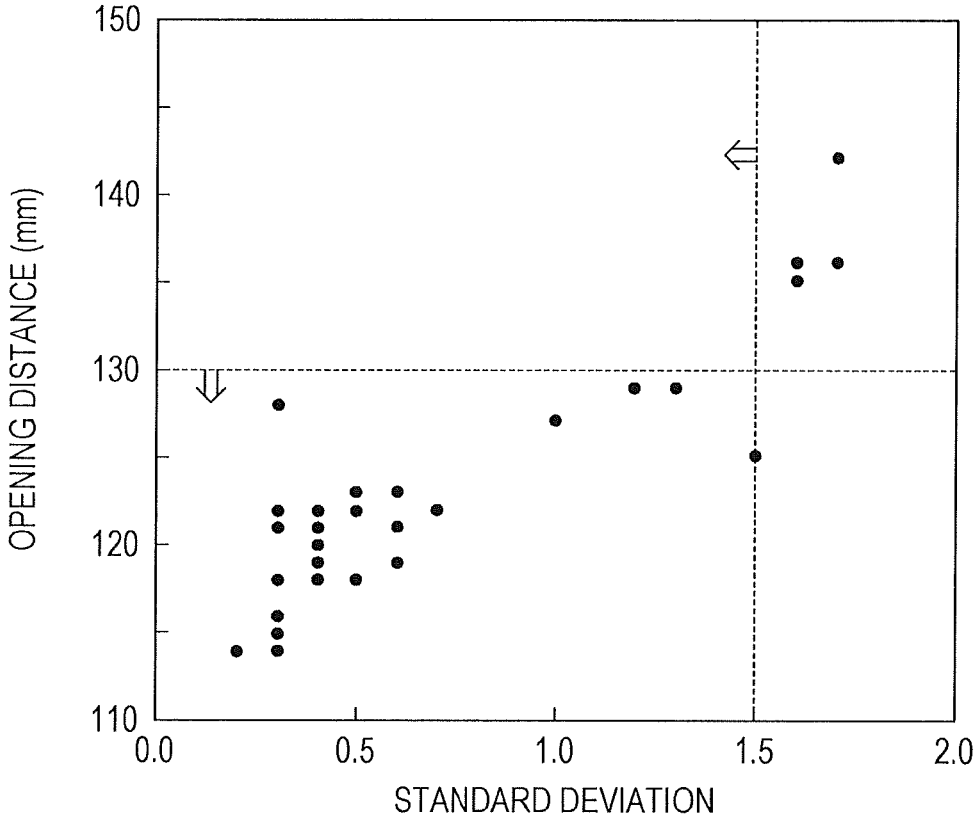
FIG. 3 is a graph showing the relationship between the opening distance after press forming and the standard deviation of natural logarithm values of precipitate particle sizes.

The obtained results are shown in FIGS. 2 and 3.

Among the obtained results, FIG. 2 shows the relationship between the yield strength (YP) and the number density of precipitates having a particle size of less than 10 nm with respect to steel sheets having a microstructure in which the area percentage of ferrite phase is 95% or more. As is clear from FIG. 2, to ensure the yield strength YP of 1,000 MPa or more, it is necessary that the number density of precipitates having a particle size of less than 10 nm is specified to be $1.0\times10^5/\mu m^3$ or more.

However, we also found that excellent shape fixability was not obtained by merely forming fine precipitates at a high number density. We further found that to ensure excellent shape fixability stably, reduction in particle size variation of fine precipitates was necessary.

Then, to evaluate the influence of particle size variation of fine precipitates, natural logarithm values of particle sizes of the individual fine precipitates having a particle size of less than 10 nm were determined, and the standard deviation of those values was calculated.

Among the obtained results, FIG. 3 shows the relationship between the opening distance serving as an indicator of the shape fixability and the standard deviation of the natural logarithm values of particle sizes of the individual fine precipitates having a particle size of less than 10 nm with respect to steel sheets having a microstructure in which the area percentage of ferrite phase is 95% or more and the number density of precipitates having a particle size of less than 10 nm is $1.0\times10^5/\mu m^3$ or more.

As is clear from FIG. 3, there is a tendency of the opening distance to decrease as the standard deviation decreases. We found from FIG. 3 that to ensure excellent shape fixability with small springback, for example, the opening distance of less than 130 mm, adjustment of the standard deviation of natural logarithm values of particle sizes of the fine precipitates having a particle size of less than 10 nm to be 1.5 or less was necessary.

Consequently, we believe that when the standard deviation of natural logarithms of particle sizes of fine precipitates increased, that is, variations in particle sizes of fine precipitates increased, the large precipitates increased relatively and, thereby, dislocations were concentrated around the large precipitates easily, interactions occurred between dislocations, movements of dislocations were hindered, plastic deformation was suppressed, the degree of dependence of deformation on elastic deformation increased, springback occurred easily, and shape defect occurred easily.

On that basis, we found that a high strength steel sheet having a yield strength (YP) of 1,000 MPa or more and, in addition, excellent shape fixability was obtained by forming precipitates in a microstructure having an area percentage of ferrite phase of 95% or more, wherein a number density of precipitates having a particle size of less than 10 nm is specified to be $1.0\times10^5/\mu m^3$ or more, and a standard deviation of natural logarithm values of particle sizes of precipitates less than 10 nm is specified to be 1.5 or less.

Reasons for the limitation of the chemical composition of the high strength steel sheet will be described. Hereafter "percent by mass" is simply expressed as "%".

C: 0.08% to 0.20%

C is combined with V to form V carbides and contributes to enhancement of strength. Also, C has a function of lowering the ferrite transformation start temperature, lowers the precipitation temperature of carbides, and contributes to precipitation of finer carbides during cooling after hot rolling. Furthermore, C contributes to suppression of coarsening of carbides during cooling after coiling. It is necessary that the high strength steel sheet contains 0.08% or more of C to obtain such effects. On the other hand, if the C content is more than 0.20%, ferrite transformation is suppressed, and transformation to bainite or martensite is facilitated so that formation of fine V carbides in the ferrite phase is suppressed. Consequently, the C content is limited to 0.08% to 0.20%. In this regard, the C content is preferably 0.10% to 0.18%, more preferably 0.12% to 0.18%, and further preferably 0.14% to 0.18%.

Si: 0.3% or less

Si has a function of facilitating ferrite transformation and increasing the ferrite transformation start temperature, increases the precipitation temperature of carbides and, thereby, precipitates coarse carbides during cooling after hot rolling. Also, Si forms Si oxides on the steel sheet surface in an annealing treatment and the like after hot rolling. The Si oxides have an adverse effect of hindering coatability considerably. For example, coating defect portions are generated in a coating treatment. Consequently, the Si content is limited to 0.3% or less. In this regard, the Si content is preferably 0.1% or less, more preferably 0.05% or less, and further preferably 0.03% or less.

Mn: 0.1% to 3.0%

Mn contributes to lowering of the ferrite transformation start temperature during cooling after hot rolling. According to this, the precipitation temperature of carbides is lowered, and carbides can be made finer. Furthermore, Mn contributes to enhancement of the strength of the steel sheet through a function of making ferrite grains finer in addition to solid solution hardening. Also, Mn has a function of combining with harmful S in the steel as MnS to render S harmless. It is necessary that the Mn content be 0.1% or more to obtain such effects. On the other hand, if the Mn content is more than 3.0%, ferrite transformation is suppressed, and transformation to bainite or martensite is facilitated so that formation of fine V carbides in the ferrite phase is suppressed. Consequently, the Mn content is limited to 0.1% to 3.0%. In this regard, the Mn content is preferably 0.3% to 2.0%, more preferably 0.5% to 2.0%, and further preferably 1.0% to 1.5%.

P: 0.10% or less

P is an element which segregates at grain boundaries to degrade the ductility and the toughness. Also, P facilitates ferrite transformation, increases the ferrite transformation start temperature, increases the precipitation temperature of carbides, and precipitates coarse carbides during cooling after hot rolling. Therefore, it is preferable that the P content be minimized. However, the P content of up to 0.10% is permissible. Consequently, the P content is limited to 0.10% or less. In this regard, the P content is preferably 0.05% or less, more preferably 0.03% or less, and further preferably 0.01% or less.

S: 0.030% or less

S considerably degrades hot ductility and, thereby, induces hot cracking, and degrades the surface quality considerably. Also, S hardly contributes to enhancement of the strength and, in addition, serves as an impurity element to form coarse sulfides and degrades the ductility and the stretch flangeability of the steel sheet. Such situation becomes remarkable if the S content is more than 0.030%. Consequently, the S content is limited to 0.030% or less. In this regard, the S content is preferably 0.010% or less, more preferably 0.003% or less, and further preferably 0.001% or less.

Al: 0.10% or less

Al facilitates ferrite transformation, increases the precipitation temperature of carbides through an increase in the ferrite transformation start temperature, and precipitates coarse carbides during cooling after hot rolling. Meanwhile, if the Al content is more than 0.10%, an increase in Al oxides is caused and the ductility of the steel sheet is degraded. Consequently, the Al content is limited to 0.10% or less. Also, the Al content is preferably 0.05% or less. In this regard, the lower limit is not necessarily specifically limited. Al functions as a deoxidizing agent, and when 0.01% or more of Al is contained in a high strength steel sheet serving as an Al killed steel, there is no problem.

N: 0.010% or less

When V is contained, N is combined with V at a high temperature to form coarse V nitrides. The coarse V nitrides hardly contribute to enhancement of the strength so that an effect of enhancing the strength due to addition of V is reduced. Meanwhile, if much N is contained, slab cracking occurs during hot rolling, so that many surface flaws may be generated. Consequently, the N content is limited to 0.010% or less. In this regard, the N content is preferably 0.005% or less, more preferably 0.003% or less, and further preferably 0.002% or less.

V: 0.20% to 0.80%

Vanadium is combined with C to form fine carbides and contributes to enhancement of the strength of the steel sheet. It is necessary that the V content be 0.20% or more to obtain such an effect. On the other hand, if the V content is more than 0.80%, ferrite transformation is facilitated, the precipitation temperature of carbides is increased through an increase in the ferrite transformation start temperature, and coarse carbides are precipitated during cooling after hot rolling. Consequently, the V content is limited to 0.20% to 0.80%. In this regard, the V content is preferably 0.25% to 0.60%, more preferably 0.30% to 0.50%, and further preferably 0.35% to 0.50%.

The above-described chemical composition is a basic one contained in the high strength steel sheet. Also, as necessary, the high strength steel sheet can further contain at least one group selected from the following Group A to Group F as selective elements in addition to the basic chemical composition.

Group A: Ti: 0.005% to 0.20%

Ti in Group A forms fine complex carbides with V and C to contribute to enhancement of the strength. It is necessary that the Ti content be 0.005% or more to obtain such an effect. On the other hand, if the Ti content is more than 0.20%, coarse carbides are formed at a high temperature. Consequently, when Ti is contained, the Ti content in Group A is preferably limited to 0.005% to 0.20%, more preferably 0.05% to 0.15%, and further preferably 0.08% to 0.15%.

Group B: at least one selected from Nb: 0.005% to 0.50%, Mo: 0.005% to 0.50%, Ta: 0.005% to 0.50%, and W: 0.005% to 0.50%

Each of Nb, Mo, Ta, and W in Group B is an element to form fine precipitates and contribute to enhancement of the strength through precipitation hardening. The high strength steel sheet can contain at least one listed in Group B in accordance with necessity. A preferable content of each element is 0.005% or more as for Nb, 0.005% or more as for Mo, 0.005% or more as for Ta, and 0.005% or more as for W to obtain such an effect. On the other hand, even when the content of each of Nb, Mo, Ta, and W is more than 0.50%, the effect is saturated, and the effect commensurate with the content cannot be expected so that there is an economic disadvantage. Consequently, when at least one listed in Group B is contained, it is preferable that the Nb content be limited to 0.005% to 0.50%, the Mo content be limited to 0.005% to 0.50%, the Ta content be limited to 0.005% to 0.50%, and the W content be limited to 0.005% to 0.50%.

Group C: B: 0.0002% to 0.0050%

B in Group C lowers the ferrite transformation start temperature and contributes to formation of finer carbides through lowering of the precipitation temperature of carbides during cooling after hot rolling. Also, B segregates at grain boundaries to improve resistance to secondary working embrittlement. It is preferable that the B content be 0.0002% or more to obtain such an effect. On the other hand, if the B content is more than 0.0050%, a hot deformation resistance increases, and hot rolling becomes difficult. Consequently, when B is contained, the B content in Group C is limited to the range of preferably 0.0002% to 0.0050%, more preferably 0.0005% to 0.0030%, and further preferably 0.0010% to 0.0020%.

Group D: at least one selected from Cr: 0.01% to 1.0%, Ni: 0.01% to 1.0%, and Cu: 0.01% to 1.0%

Each of Cr, Ni, and Cu in Group D is an element to contribute to enhancement of the strength through forming fine grain microstructure. The high strength steel sheet can contain at least one listed in Group D, as necessary. A preferable content of each element is 0.01% or more as for Cr, 0.01% or more as for Ni, and 0.01% or more as for Cu to obtain such an effect. On the other hand, even when any one of the elements is contained such that the Cr content is more than 1.0%, the Ni content is more than 1.0%, and the Cu content is more than 1.0%, the effect is saturated, and the effect commensurate with the content cannot be expected so that there is an economic disadvantage. Consequently, when at least one listed in Group D is contained, it is preferable that the Cr content be limited to 0.01% to 1.0%, the Ni content be limited to 0.01% to 1.0%, and the Cu content be limited to 0.01% to 1.0%.

Group E: Sb: 0.005% to 0.050%

Sb in Group E is an element which segregates on the steel (slab) surface during hot rolling and has a function of preventing nitriding from the steel surface and suppressing formation of large nitrides. It is preferable that the Sb content be 0.005% or more to obtain such an effect. On the other hand, even when the Sb content is more than 0.050%, the effect is saturated, and the effect commensurate with the content cannot be expected so that there is an economic disadvantage. Consequently, when Sb is contained, it is preferable that the Sb content be limited to 0.005% to 0.050%.

Group F: at least one selected from Ca: 0.0005% to 0.01% and REM: 0.0005% to 0.01%

Each of Ca and REM in Group F is an element having a function of controlling the form of sulfides and improving the ductility and the stretch flangeability. The high strength steel sheet can contain at least one listed in Group F, as necessary. A preferable content of each element is 0.0005% or more as for Ca and 0.0005% or more as for REM to obtain such an effect. On the other hand, even when any one of the elements is contained such that the Ca content is more than 0.01% and the REM content is more than 0.01%, the effect is saturated, and the effect commensurate with the content cannot be expected, so that there is an economic disadvantage. Consequently, when at least one listed in Group F is contained, it is preferable that the Ca content be limited to 0.0005% to 0.01% and the REM content be limited to 0.0005% to 0.01%.

The remainder of the above-described chemical composition is composed of Fe and incidental impurities. In this regard, examples of incidental impurities include Sn, Mg, Co, As, Pb, Zn, and O. A permissible content of these elements in total is 0.5% or less.

Next, reasons for the limitation of the microstructure of the high strength steel sheet will be described.

The high strength steel sheet has a microstructure including 95% or more of ferrite phase on an area percentage basis, in which precipitates having a particle size of less than 10 nm are dispersed having a distribution in such a way that the number density is $1.0\times10^5/\mu m^3$ or more and the standard deviation of natural logarithm values of precipitate particle sizes is 1.5 or less.

Ferrite phase: 95% or more on an area percentage basis

The high strength steel sheet includes ferrite phase as a main phase. Here, the "main phase" refers to when the area percentage is 95% or more. As for a second phase besides the main phase, martensite phase or bainite phase is mentioned. When the phase other than the main phase is included, the area percentage of the phase other than the main phase is specified to be preferably 5% or less in total. This is because if low-temperature transformation phase, e.g., bainite phase or martensite phase, is present as a second phase, a mobile dislocation is introduced because of transformation strain and the yield strength YP is reduced. Meanwhile, the microstructure percentage of ferrite phase serving as a main phase is preferably 98% or more, and more preferably 100% on an area percentage basis. In this regard, the area percentage is obtained on the basis of a measurement by the method described in the examples.

To ensure the predetermined high strength, large amounts of fine precipitates having a particle size of less than 10 nm and having a large influence on increase in the strength are dispersed in ferrite phase.

Number density of precipitates having a particle size of less than 10 nm: $1.0\times10^5/\mu m^3$ or more Coarse precipitates hardly exert an influence on the strength. It is necessary that fine precipitates be dispersed to ensure a high yield strength of 1,000 MPa or more. As shown in FIG. 2, the number density of precipitates having a particle size of less than 10 nm is specified to be $1.0\times10^5/\mu m^3$ or more (where the particle size is the maximum particle size of precipitate). If the number density of precipitates having a particle size of less than 10 nm is less than $1.0\times10^5/\mu m^3$, the predetermined strength (the yield strength YP is 1,000 MPa or more) cannot be ensured stably. Consequently, the number density of precipitates having a particle size of less than 10 nm is limited to $1.0\times10^5/\mu m^3$ or more. In this regard, the above-described number density is preferably $2.0\times10^5/\mu m^3$ or more, more preferably $3.0\times10^5/\mu m^3$ or more, and further preferably $4.0\times10^5/\mu m^3$ or more. Meanwhile, the high strength is ensured more easily as the particle size of precipitates decreases. Therefore, the particle size of precipitates is preferably less than 5 nm, and further preferably less than 3 nm.

Standard deviation of natural logarithm values of precipitate particle sizes with respect to precipitates having particle size of less than 10 nm: 1.5 or less If the standard deviation of natural logarithm values of precipitate particle sizes with respect to precipitates having a particle size of less than 10 nm increases to more than 1.5, that is, if variations in particle sizes of fine precipitates increase, the opening distance increases, as shown in FIG. 3, and the shape fixability is degraded. Consequently, the standard deviation of natural logarithm values of precipitate particle sizes with respect to precipitates having a particle size of less than 10 nm is limited to 1.5 or less. In this regard, the above-described standard deviation is preferably 1.0 or less, more preferably 0.5 or less, and further preferably 0.3 or less.

In this regard, the standard deviation of natural logarithm values of precipitate particle sizes is calculated by formula (1).

$$\text{standard deviation } \sigma=\sqrt{\{\Sigma_i(\ln d_m-\ln d_i)^2/n\}} \quad (1)$$

where $\ln d_m$: natural logarithm of average precipitate particle size (nm), $\ln d_i$: natural logarithm of each precipitate particle size (nm)

n: the number of data

When the standard deviation of natural logarithm of precipitate particle sizes with respect to fine precipitates having a particle size of less than 10 nm increases, that is, variations in particle sizes of fine precipitates increase, the large precipitates increase relatively. Therefore, we believe that dislocations are concentrated around the large precipitates easily, interactions occur between dislocations, movements of dislocations are hindered, plastic deformation is suppressed, the degree of dependence of deformation on elastic deformation increases, springback occurs easily, and shape defect occurs easily. Consequently, reduction in the size distribution of fine precipitates less than 10 nm is important to improve shape fixability.

Meanwhile, the high strength steel sheet may be provided with a coating film or a chemical conversion film on the surface of the above-described steel sheet. Examples of coating film include the films coated by galvanization, galvannealing, and electrogalvanization.

Next, a preferable method of manufacturing the high strength steel sheet will be described.

A starting material is specified to be a steel (slab) having the above-described chemical composition. The method of manufacturing the steel is not necessarily specifically limited. For example, it is preferable that a molten steel having the above-described composition be smelted by a common smelting method, e.g., a converter, and a steel, e.g., a slab, be produced by a common casting method, e.g., a continuous casting method.

Subsequently, the resulting steel is subjected to a hot rolling process or further subjected to a coating annealing process so that a hot rolled steel sheet having a predetermined size is produced.

In the hot rolling process, the steel is then subjected to the hot rolling process composed of rough rolling, finish rolling, cooling and coiling into the shape of a coil at a coiling temperature, in which the rough rolling is performed without heating the steel or after cooling once and heating the steel.

Heating temperature: 1,100° C. or higher

The steel (slab or the like) is heated to a high temperature of 1,100° C. or higher to dissolve carbide-forming elements. Consequently, the carbide-forming elements are allowed to be sufficiently dissolved and fine carbides can be precipitated during cooling after hot rolling or during cooling after coiling. If the heating temperature is lower than 1,100° C., the carbide-forming elements are not allowed to be sufficiently dissolved, so that fine carbides cannot be dispersed. Meanwhile, the heating temperature is preferably 1,150° C. or higher, more preferably 1,220° C. or higher, and further preferably 1,250° C. or higher. In this regard, the upper limit of the heating temperature is not necessarily specifically limited. The upper limit of the heating temperature is preferably 1,350° C. or lower, and more preferably 1,300° C. or lower from the viewpoint of surface quality. For example, the surface quality is degraded because of melting of scale at a heating temperature of higher than 1,350° C. Also, the holding time at the heating temperature is 10 min or more. If the holding time is less than 10 min, the carbide-forming elements are not allowed to be sufficiently dissolved. In this regard, the holding time is preferably 30 min or more. Meanwhile, the upper limit of the holding time is not necessarily specifically limited. The upper limit of the holding time is preferably 300 min or less, more preferably 180 min or less, and further preferably 120 min or less because excessively long time of holding at a high temperature increases an energy cost.

Initially, the heated steel is subjected to rough rolling in the hot rolling process. The finish rough rolling temperature is 1,000° C. or higher.

Finish rough rolling temperature: 1,000° C. or higher

If the finish rough rolling temperature is lower than 1,000° C., crystal grains of austenite become small. Consequently, grain boundaries serve as precipitation sites of precipitates and precipitation of coarse carbides is facilitated between completion of the rough rolling and completion of the finish rolling. Therefore, the finish rough rolling temperature is 1,000° C. or higher. In this regard, the finish rough rolling temperature is preferably 1,050° C. or higher, and further preferably 1,100° C. or higher.

Subsequently, the steel is subjected to finish rolling after the rough rolling. The reduction ratio of finish rolling is 96% or less in a temperature range of 1,000° C. or lower and to be 80% or less in a temperature range of 950° C. or lower. The finishing temperature is 850° C. or higher.

Reduction ratio in a temperature range of 1,000° C. or lower:96% or less

If the reduction ratio in a temperature range of 1,000° C. or lower increases to more than 96%, the average grain size of austenite (γ) decreases. However, the γ grains become coarse easily because of grain growth thereafter. As a result, the grain size distribution of the resulting γ becomes on the large grain size side easily. Then, in the cooling after finish rolling, ferrite (α) transformation from large γ is suppressed and occurs on the low temperature side so that fine carbides are precipitated and carbides having small particle sizes increase. On the other hand, ferrite (α) transformation from small γ occurs on the higher temperature side so that coarse carbides are precipitated easily. Consequently, if the reduction ratio in a temperature range of 1,000° C. or lower increases to more than 96%, the size distribution of precipitates increases easily. Therefore, the reduction ratio in a temperature range of 1,000° C. or lower is limited to 96% or less. In this regard, the reduction ratio in a temperature range of 1,000° C. or lower is preferably 90% or less, more preferably 70% or less, and further preferably 50% or less.

Reduction ratio in a temperature range of 950° C. or lower:80% or less

If the reduction ratio in a temperature range of 950° C. or lower increases to more than 80%, α transformation from unrecrystallized austenite (γ) is facilitated easily. The unrecrystallized γ is transformed to a at a high temperature during cooling after finish rolling and, thereby, the precipitation temperature of the carbides increases and carbides (precipitates) become large. According to this, the grain size distribution of precipitates (carbides) becomes large easily. Therefore, the reduction ratio in a temperature range of 950° C. or lower is limited to 80% or less. In this regard, the reduction ratio in a temperature range of 950° C. or lower is preferably 70% or less, more preferably 50% or less, and further preferably 25% or less. The reduction ratio of 80% or less in a temperature range of 950° C. or lower includes the case where the reduction ratio is 0%.

Finishing temperature: 850° C. or higher

As the finishing temperature of finish rolling becomes low, dislocations are accumulated so that α transformation is facilitated during cooling after finish rolling, the carbide precipitation temperature increases, and large carbides (precipitates) are precipitated easily. Meanwhile, if the finishing temperature decreases to an cc region, coarse carbides are precipitated because of strain-induced precipitation. Consequently, the finishing temperature is limited to 850° C. or higher. In this regard, the finishing temperature is preferably 880° C. or higher, more preferably 920° C. or higher, and further preferably 940° C. or higher.

After the finish rolling (hot rolling) is completed, the steel sheet is cooled and is coiled into the shape of a coil at a predetermined coiling temperature.

The precipitation behavior of carbidesis influenced by the amount of V. Therefore, the cooling and the coiling temperature are adjusted in relation to the V content [V].

The cooling after finish rolling is performed at an average cooling rate of (30×[V])° C./s or more in a temperature range from the finishing temperature to 750° C. and at an average cooling rate of (10×[V])° C./s or more in a temperature range from 750° C. to the coiling temperature, in relation to the V content [V].

Average cooling rate in a temperature range from the finishing temperature to 750° C.: (30×[V])° C./s or more When the average cooling rate in a temperature range from the finishing temperature to 750° C. is less than (30×[V])° C./s, the ferrite transformation is facilitated so that the precipitation temperature of the carbides (precipitates) is high and large carbides are precipitated easily. Consequently, the average cooling rate from the finishing temperature to 750° C. is limited to (30×[V])° C./s or more in relation to the V content [V]. In this regard, the above-described average cooling rate is preferably (50×[V])° C./s or more, more preferably (100×[V])° C./s or more, and further preferably (150×[V])° C./s or more. The upper limit of the average cooling rate from the finishing temperature to 750° C. is not necessarily specifically limited. The upper limit of the above-described average cooling rate is preferably (500×[V])° C./s or less from the viewpoint of restrictions on the equipment.

Average cooling rate in a temperature range from 750° C. to the coiling temperature: (10×[V])° C./s or more When the average cooling rate in a temperature range from 750° C. to the coiling temperature is less than (10×[V])° C./s, the ferrite transformation proceeds slowly so that transformation starting temperatures are different depending on the portions of steel sheet, there are large variations in particle size of carbides, and the size distribution of carbides increases. Consequently, the average cooling rate from 750° C. to the coiling temperature is limited to (10×[V])° C./s or more. In this regard, the above-described average cooling rate is preferably (20×[V])° C./s or more, more preferably (30×[V])° C./s or more, and further preferably (50×[V])° C./s or more. The upper limit of the average cooling rate from 750° C. to the coiling temperature is not necessarily specifically limited, although about 1,000° C./s or less is preferable and 300° C./s or less is more preferable from the viewpoint of easy control of the coiling temperature.

Coiling temperature: 500° C. to (700-50×[V])° C.

The particle size of produced carbides is changed by the coiling temperature. If the coiling temperature is high, coarse carbides are precipitated easily. Meanwhile, if the coiling temperature is low, precipitation of carbides is suppressed, and there is a strong tendency of a low-temperature transformation phase, e.g., bainite or martensite, to generate. Such a tendency becomes remarkable in relation to the V content [V] and, therefore, the coiling temperature is limited in relation to the V content [V].

When the coiling temperature is lower than 500° C., precipitation of carbides is suppressed, and a low-temperature transformation phase, e.g., bainite or martensite, is generated. On the other hand, if the coiling temperature is higher than (700-50×[V])° C., carbides become coarse. Consequently, the coiling temperature is limited to 500° C. to (700-50×[V])° C. In this regard, the above-described coiling temperature is preferably 530° C. or higher and (700-100×[V])° C. or lower, more preferably 530° C. or higher and (700-150×[V])° C. or lower, and further preferably 530° C. or higher and (700-200×[V])° C. or lower.

After the above-described hot rolling process, the hot rolled sheet may be further subjected to the coating annealing process composed of pickling and coating annealing treatment to form a galvanization layer on the steel sheet surface.

The coating annealing treatment is performed by heating the hot rolled sheet in a temperature range from 500° C. to a soaking temperature of (800-200×[C]), in relation to the C content [C] (percent by mass) at an average heating rate of (5×[C])° C./s or more, holding the steel sheet for a soaking time of 1,000 s or less, cooling the steel sheet to a zinc coating bath temperature of 420° C. to 500° C. at an average cooling rate of 1° C./s or more, and dipping the steel sheet into the zinc coating bath. In this regard, change in particle size of carbides in the coating annealing treatment is remarkably influenced by the C content [C] (percent by mass). Therefore, the average heating rate, the average cooling rate, and the soaking temperature in the coating annealing treatment are adjusted in relation to the C content [C].

Average heating rate from 500° C. to a soaking temperature: (5×[C])° C./s or more When galvanization is applied, if the average heating rate from 500° C. to the soaking temperature is less than (5×[C])° C./s, fine carbides (precipitates) precipitated in the hot rolling process become coarse. Consequently, the average heating rate from 500° C. to the soaking temperature is limited to (5×[C])° C./s or more. In this regard, the above-described average heating rate is preferably (10×[C])° C./s or more. Meanwhile, the upper limit of the average heating rate is not specifically limited, although about 1,000° C./s or less is preferable because control of the soaking temperature becomes difficult as the average heating rate increases. In this regard, the upper limit of the above-described average heating rate is preferably 300° C./s or less, more preferably 100° C./s or less, and further preferably 50° C./s or less.

Soaking temperature: (800-200×[C])° C. or lower

If the soaking temperature increases, fine precipitates (carbides) which have been precipitated become coarse. Such a tendency becomes remarkable as the C content increases. Therefore, the soaking temperature is limited to (800-200×[C])° C. or lower in relation to the C content [C]. In this regard, the soaking temperature is preferably (800-300×[C])° C. or lower, and more preferably (800-400×[C])° C. or lower. Meanwhile, the lower limit of the soaking temperature is not specifically limited, although 420° C. to 520° C., which is the galvanizing bath temperature, is enough in consideration of dipping into a galvanizing bath. In this regard, when surface quality of the coating is required, the soaking temperature is preferably 600° C. or higher, and more preferably 650° C. or higher.

Soaking time: 1,000 s or less

If the soaking time is more than 1,000 s, fine precipitates (carbides) which have been precipitated become coarse. Consequently, the soaking time is limited to 1,000 s or less. In this regard, the soaking time is preferably 500 s or less, more preferably 300 s or less, and further preferably 150 s or less. Meanwhile, the lower limit of the soaking time is not specifically limited, although the object of the present invention can be achieved by holding for 1 s or more.

Then, the hot rolled sheet soaked at the above-described temperature for the above-described time is dipped into a galvanizing bath to form a galvanization layer on the steel sheet surface.

Average cooling rate from the soaking temperature to a galvanizing bath temperature: 1° C./s or more If the average cooling rate from the soaking temperature to a galvanizing bath temperature is less than 1° C./s, fine precipitates (carbides) which have been precipitated become coarse. Consequently, the average cooling rate from the soaking temperature to a galvanizing bath temperature is limited to 1° C./s or more. In this regard, the above-described average cooling rate is preferably 3° C./s or more, more preferably 5° C./s or more, and further preferably 10° C./s or more. Meanwhile, the upper limit of the average cooling rate is not specifically limited, although 100° C./s or less is sufficient from the viewpoint of restrictions on the equipment.

In this connection, the coating bath temperature and the dipping time may be adjusted appropriately in accordance with the coating thickness and the like.

Reheating treatment condition: holding at 460° C. to 600° C. for 1 s or more

The reheating treatment is performed to alloy Zn in the coating film with Fe. It is necessary that holding be performed at 460° C. or higher to alloy the coating film. On the other hand, if the reheating temperature is higher than 600° C., alloying proceeds excessively and the coating film becomes brittle. Consequently, the reheating treatment temperature is limited to 460° C. to 600° C. In this regard, the reheating treatment temperature is preferably 570° C. or lower.

Meanwhile, it is necessary that the holding time is specified to be 1 s or more. However, precipitates become coarse by a long time of holding. The purpose can be achieved sufficiently by about 10 s or less of holding time. In this regard, the holding time is preferably 5 s or less.

Meanwhile, the coating may be a composite coating of zinc and Al, a composite coating of zinc and Ni, an Al coating, a composite coating of Al and Si, and the like besides the zinc coating described above.

Also, the tempering treatment may be applied after the hot rolling process or the coating annealing process is applied.

When the steel sheet is subjected to the tempering treatment which provides a light working after the hot rolling process or the coating annealing process, mobile dislocations increase and the shape fixability can be improved. For such a purpose, it is preferable that the tempering treatment is applied at a thickness decrease ratio (reduction ratio) of 0.1% or more. In this regard, the thickness decrease ratio is preferably 0.3% or more. If the thickness decrease ratio becomes more than 3.0%, dislocations do not move easily because of interactions between dislocations so that the shape fixability is degraded. Consequently, when the tempering treatment is applied, it is preferable to limit to a treatment at a thickness decrease ratio of 0.1% to 3.0%. In this regard, the thickness decrease ratio is preferably 2.0% or less, and further preferably 1.0% or less. Meanwhile, working may be working by a reduction roll, working by pulling, or composite working of rolling (cold rolling) and pulling.

Our steel sheets and methods will be further described below with reference to examples.

EXAMPLE 1

A molten steel having a chemical composition shown in Table 1-1 and Table 1-2 was smelted in a converter, made into a slab (steel thickness was 250 mm) by a continuous casting method, and subjected to the hot rolling process or further subjected to the coating annealing process under the conditions shown in Table 2-1 and Table 2-2, so as to produce a steel sheet having a sheet thickness shown in Table 3-1 and Table 3-2.

Test pieces were taken from the steel sheet, and a microstructure observation, a tensile test, and a shape fixability evaluation test were performed. The test methods were as described below.

(1) Microstructure Observation

A test piece for microstructure observation was taken from the steel sheet, a cross-section in the rolling direction (L cross-section) was polished, and corrosion with nital was performed. Thereafter, a microstructure observation was performed with an optical microscope (magnification of 500 times). A region in the range of 300 μm×300 μm was observed, and the types of the microstructure and the area percentages thereof were determined.

In addition, a thin film test piece was taken from the steel sheet, and polished to prepare a thin film sample. Thereafter, the number density of precipitates having a particle size of less than 10 nm and the individual precipitate particle sizes were measured with a transmission electron microscope (TEM). The number density of precipitates less than 10 nm (number/$\mu m^3$) was calculated by counting the number of precipitates less than 10 nm in the regions of the range of 100×100 $nm^2$ at ten fields and, in addition, determining the film thickness in the field of view by a convergent beam electron diffraction method. Also, as for particle sizes of precipitates, the same thin film sample was used, the size $d_i$ of each of 500 precipitates less than 10 nm was measured, and the average particle size $d_m$ was determined by arithmetically averaging them. In addition, natural logarithms $\ln d_i$ of the particle sizes $d_i$ were determined and the standard deviation σ of them was calculated. In this regard, the precipitate was not spherical and, therefore, a maximum particle size of the precipitate was taken as a particle size of each precipitate. The standard deviation a was calculated on the basis of formula (1).

$$\text{standard deviation } \sigma=\sqrt{\{\Sigma_i(\ln d_m-\ln d_i)^2/n\}} \quad (1)$$

where $\ln d_m$: natural logarithm of average precipitate particle size (nm), $\ln d_i$: natural logarithm of each precipitate particle size (nm)

n: the number of data (2) Tensile Test

A JIS No. 5 tensile test piece was cut from the steel sheet, where the tensile direction was the direction at a right angle to the rolling direction. A tensile test was performed in conformity with the specification of JIS Z 2241 and the yield strength YP, the tensile strength TS, and the total elongation E1 were determined.

(3) Shape Fixability Evaluation Test

A test piece (size: 80 mm×360 mm) was taken from the steel sheet, and press forming was performed to produce a hat-shaped member as shown in FIG. 1. In this regard, in the press forming, a blank holder pressure was specified to be 20 tons and the die shoulder radius R was specified to be 5 mm. After the press forming, the opening distance was measured in the manner shown in FIG. 1. Meanwhile, as for some test pieces, warm press forming was employed, where the test pieces were heated to the press forming temperature shown in Table 3-1 and Table 3-2, and the press forming was performed. The obtained results are shown in Table 3-1 and Table 3-2.

TABLE 1-1

| | Chemical component (percent by mass) | | | | | | | | | | | | | | |
|---|---|---|---|---|---|---|---|---|---|---|---|---|---|---|---|
| Steel No. | C | Si | Mn | P | S | Al | N | V | Group A Ti | Group B Nb, Mo, Ta, W | Group C B | Group D Cr, Ni, Cu | Group E Sb | Group F Ca, REM | Remarks |
| 1 | 0.14 | 0.01 | 1.5 | 0.01 | 0.001 | 0.04 | 0.003 | 0.30 | 0.10 | — | — | — | — | — | Compatible example |
| 2 | 0.07 | 0.02 | 1.3 | 0.01 | 0.001 | 0.04 | 0.004 | 0.35 | 0.09 | — | — | — | — | — | Comparative example |
| 3 | 0.08 | 0.02 | 0.5 | 0.01 | 0.002 | 0.05 | 0.005 | 0.35 | 0.14 | — | — | — | — | — | Compatible example |
| 4 | 0.10 | 0.01 | 0.4 | 0.02 | 0.010 | 0.06 | 0.005 | 0.40 | 0.12 | — | — | — | — | — | Compatible example |
| 5 | 0.12 | 0.01 | 0.6 | 0.01 | 0.002 | 0.01 | 0.004 | 0.45 | — | — | — | — | — | — | Compatible example |
| 6 | 0.16 | 0.05 | 0.8 | 0.03 | 0.003 | 0.02 | 0.004 | 0.35 | 0.08 | — | — | Cr: 0.02 | — | — | Compatible example |
| 7 | 0.18 | 0.03 | 1.0 | 0.02 | 0.001 | 0.08 | 0.007 | 0.25 | 0.05 | — | — | Ni: 0.02 | — | — | Compatible example |
| 8 | 0.20 | 0.01 | 1.2 | 0.01 | 0.001 | 0.04 | 0.005 | 0.20 | — | — | — | — | — | — | Compatible example |
| 9 | 0.21 | 0.01 | 0.9 | 0.01 | 0.002 | 0.05 | 0.006 | 0.40 | 0.11 | — | — | — | — | — | Comparative example |
| 10 | 0.13 | 0.30 | 1.2 | 0.01 | 0.001 | 0.04 | 0.008 | 0.45 | 0.005 | — | — | — | — | — | Compatible example |
| 11 | 0.15 | 0.10 | 0.4 | 0.02 | 0.004 | 0.10 | 0.005 | 0.38 | 0.09 | — | — | — | — | — | Compatible example |
| 12 | 0.16 | 0.05 | 0.5 | 0.01 | 0.030 | 0.08 | 0.006 | 0.42 | — | — | — | Cu: 0.02 | — | — | Compatible example |
| 13 | 0.15 | 0.01 | 0.1 | 0.01 | 0.010 | 0.05 | 0.004 | 0.50 | 0.11 | — | — | Cr: 0.02, Ni: 0.02 | — | — | Compatible example |
| 14 | 0.15 | 0.02 | 0.3 | 0.01 | 0.003 | 0.06 | 0.010 | 0.60 | 0.09 | — | — | — | — | — | Compatible example |
| 15 | 0.14 | 0.02 | 0.5 | 0.05 | 0.002 | 0.03 | 0.003 | 0.80 | 0.11 | — | — | — | — | — | Compatible example |
| 16 | 0.12 | 0.03 | 1.0 | 0.10 | 0.010 | 0.04 | 0.004 | 0.45 | 0.12 | — | — | Cr: 0.02, Ni: 0.02, Cu: 0.02 | — | — | Compatible example |
| 17 | 0.16 | 0.01 | 2.0 | 0.01 | 0.020 | 0.04 | 0.003 | 0.33 | 0.15 | — | — | — | — | — | Compatible example |
| 18 | 0.18 | 0.02 | 2.0 | 0.02 | 0.008 | 0.03 | 0.005 | 0.38 | 0.20 | — | — | — | — | — | Compatible example |
| 19 | 0.15 | 0.01 | 3.1 | 0.01 | 0.005 | 0.04 | 0.004 | 0.41 | 0.11 | — | — | — | — | — | Comparative example |
| 20 | 0.11 | 0.01 | 1.5 | 0.02 | 0.002 | 0.05 | 0.004 | 0.19 | — | — | — | — | — | — | Comparative example |
| 21 | 0.09 | 0.02 | 1.2 | 0.01 | 0.001 | 0.04 | 0.003 | 0.81 | 0.10 | — | — | — | — | — | Comparative example |
| 22 | 0.14 | 0.01 | 1.2 | 0.01 | 0.001 | 0.05 | 0.003 | 0.35 | — | Nb: 0.25 | — | — | — | — | Compatible example |
| 23 | 0.13 | 0.02 | 0.9 | 0.02 | 0.002 | 0.04 | 0.004 | 0.40 | 0.10 | Mo: 0.40 | — | — | — | — | Compatible example |
| 24 | 0.15 | 0.01 | 0.8 | 0.01 | 0.001 | 0.05 | 0.005 | 0.41 | 0.11 | Ta: 0.35 | — | — | — | — | Compatible example |
| 25 | 0.16 | 0.01 | 1.1 | 0.03 | 0.012 | 0.05 | 0.004 | 0.38 | 0.12 | W: 0.15 | — | — | — | — | Compatible example |
| 26 | 0.15 | 0.01 | 0.8 | 0.01 | 0.013 | 0.06 | 0.003 | 0.35 | 0.08 | Nb: 0.05, Mo: 0.35 | — | — | — | — | Compatible example |
| 27 | 0.14 | 0.02 | 0.5 | 0.01 | 0.008 | 0.04 | 0.005 | 0.30 | 0.10 | Nb: 0.005, Mo: 0.35, Ta: 0.01, W: 0.05 | — | — | — | — | Compatible example |
| 28 | 0.14 | 0.01 | 0.2 | 0.01 | 0.001 | 0.05 | 0.004 | 0.45 | 0.12 | — | 0.0015 | — | — | — | Compatible example |
| 29 | 0.12 | 0.01 | 0.5 | 0.01 | 0.002 | 0.04 | 0.005 | 0.29 | — | — | 0.0030 | — | — | — | Compatible example |
| 30 | 0.15 | 0.02 | 0.6 | 0.01 | 0.001 | 0.04 | 0.004 | 0.36 | — | Mo: 0.40 | 0.0005 | — | — | — | Compatible example |

TABLE 1-2

| Steel No. | Chemical component (percent by mass) | | | | | | | | | | | | | | Remarks |
|---|---|---|---|---|---|---|---|---|---|---|---|---|---|---|---|
| | C | Si | Mn | P | S | Al | N | V | Group A Ti | Group B Nb, Mo, Ta, W | Group C B | Group D Cr, Ni, Cu | Group E Sb | Group F Ca, REM | |
| 31 | 0.16 | 0.03 | 1.0 | 0.02 | 0.005 | 0.05 | 0.003 | 0.35 | 0.11 | — | — | Cr: 0.5 | — | — | Compatible example |
| 32 | 0.15 | 0.01 | 1.1 | 0.01 | 0.001 | 0.05 | 0.004 | 0.38 | 0.12 | — | — | — | 0.01 | — | Compatible example |
| 33 | 0.15 | 0.01 | 0.9 | 0.02 | 0.001 | 0.06 | 0.005 | 0.30 | — | — | — | — | — | Ca: 0.0005 | Compatible example |
| 34 | 0.16 | 0.01 | 0.8 | 0.01 | 0.001 | 0.05 | 0.004 | 0.42 | 0.10 | Nb: 0.02, Mo: 0.10, Ta: 0.10, W: 0.10 | 0.0005 | Cr: 0.02, Ni: 0.02, Cu: 0.01 | — | Ca: 0.0005, REM: 0.0005 | Compatible example |
| 35 | 0.14 | 0.01 | 0.9 | 0.01 | 0.001 | 0.04 | 0.003 | 0.35 | 0.11 | — | — | — | — | — | Compatible example |
| 36 | 0.13 | 0.02 | 1.2 | 0.02 | 0.001 | 0.05 | 0.004 | 0.30 | — | — | — | — | — | — | Compatible example |
| 37 | 0.11 | 0.01 | 0.5 | 0.01 | 0.002 | 0.04 | 0.003 | 0.28 | — | — | — | — | — | — | Compatible example |
| 38 | 0.15 | 0.02 | 0.6 | 0.02 | 0.008 | 0.03 | 0.005 | 0.36 | — | — | — | — | — | — | Compatible example |
| 39 | 0.18 | 0.01 | 0.8 | 0.01 | 0.005 | 0.06 | 0.006 | 0.38 | — | — | — | — | — | — | Compatible example |
| 40 | 0.19 | 0.02 | 0.7 | 0.01 | 0.006 | 0.07 | 0.003 | 0.60 | 0.11 | — | — | — | — | — | Compatible example |
| 41 | 0.11 | 0.01 | 1.3 | 0.01 | 0.001 | 0.04 | 0.004 | 0.55 | 0.12 | — | — | — | — | — | Compatible example |
| 42 | 0.12 | 0.01 | 1.5 | 0.01 | 0.002 | 0.05 | 0.005 | 0.35 | — | — | — | — | — | — | Compatible example |
| 43 | 0.18 | 0.02 | 1.5 | 0.01 | 0.007 | 0.03 | 0.002 | 0.31 | — | — | — | — | — | — | Compatible example |
| 44 | 0.09 | 0.01 | 0.6 | 0.01 | 0.011 | 0.05 | 0.003 | 0.42 | — | — | — | — | — | — | Compatible example |
| 45 | 0.13 | 0.02 | 0.5 | 0.02 | 0.015 | 0.06 | 0.004 | 0.45 | — | — | — | — | — | — | Compatible example |
| 46 | 0.09 | 0.01 | 0.3 | 0.03 | 0.012 | 0.04 | 0.002 | 0.35 | 0.11 | — | — | — | — | — | Compatible example |
| 47 | 0.08 | 0.02 | 1.5 | 0.01 | 0.005 | 0.05 | 0.006 | 0.36 | 0.12 | — | — | — | — | — | Compatible example |
| 48 | 0.12 | 0.01 | 1.5 | 0.01 | 0.006 | 0.02 | 0.005 | 0.35 | 0.10 | — | — | — | — | — | Compatible example |
| 49 | 0.14 | 0.01 | 1.1 | 0.02 | 0.008 | 0.04 | 0.007 | 0.40 | 0.10 | — | — | — | — | — | Compatible example |
| 50 | 0.13 | 0.01 | 0.6 | 0.01 | 0.004 | 0.06 | 0.005 | 0.41 | 0.10 | — | — | — | — | — | Compatible example |
| 51 | 0.15 | 0.01 | 0.5 | 0.01 | 0.001 | 0.05 | 0.003 | 0.36 | 0.09 | — | — | — | — | — | Compatible example |

TABLE 2-1

| | | Hot rolling process | | | | | | | | | Coating annealing process | | | | | | | |
|---|---|---|---|---|---|---|---|---|---|---|---|---|---|---|---|---|---|---|
| | | Heating | | Rough rolling | Finish rolling | | | Cooling | | | | | | | Reheating treatment | | | |
| | | | | Finishing | Reduction ratio | | | Cooling rate (° C./s) | | Coiling | Heating | Soaking | | Cooling | Heating | | | |
| Steel sheet No. | Steel No. | Temperature (° C.) | Holding time (min) | temperature (° C.) | 1000° C. or lower (%) | 950° C. or lower (%) | Finishing temperature (° C.) | to 750° C.* | to coiling temperature** | Coiling temperature (° C.) | Heating rate*** (° C./s) | Soaking temperature (° C.) | Holding time (s) | Cooling rate**** (° C./s) | temperature (° C.) | Holding time (s) | Tempering Reduction ratio (%) | Remarks |
| 1 | 1 | 1250 | 30 | 1150 | 90 | 20 | 940 | 30 | 15 | 570 | 2.0 | 650 | 100 | 10 | 550 | 3 | 0.5 | Example |
| 2 | 2 | 1220 | 60 | 1120 | 88 | 30 | 930 | 35 | 12 | 560 | 1.5 | 660 | 30 | 2 | 560 | 2 | 0.2 | Comparative example |
| 3 | 3 | 1230 | 50 | 1100 | 80 | 40 | 918 | 25 | 10 | 553 | 3.5 | 711 | 30 | 8 | 540 | 3 | 0.1 | Example |
| 4 | 4 | 1220 | 60 | 1160 | 50 | 0 | 960 | 15 | 15 | 540 | — | — | — | — | — | — | 0.5 | Example |
| 5 | 5 | 1100 | 10 | 1140 | 60 | 30 | 933 | 27 | 15 | 672 | — | — | — | — | — | — | 0.6 | Example |
| 6 | 6 | 1250 | 10 | 1120 | 94 | 80 | 879 | 68 | 38 | 632 | 1.7 | 750 | 50 | 5 | — | — | — | Example |
| 7 | 7 | 1250 | 60 | 1110 | 92 | 43 | 900 | 12 | 15 | 595 | 1.1 | 732 | 180 | 9 | 500 | 1 | 1.0 | Example |
| 8 | 8 | 1150 | 30 | 1050 | 94 | 50 | 910 | 50 | 25 | 570 | 3.5 | 680 | 120 | 7 | 560 | 4 | 0.8 | Example |
| 9 | 9 | 1230 | 50 | 1150 | 90 | 45 | 870 | 32 | 26 | 550 | 5.5 | 693 | 90 | 8 | 530 | 3 | 0.5 | Comparative example |
| 10 | 10 | 1250 | 300 | 1130 | 91 | 70 | 865 | 28 | 5 | 500 | 7.8 | 641 | 90 | 12 | 530 | 2 | 1.3 | Example |
| 11 | 11 | 1240 | 150 | 1120 | 92 | 80 | 850 | 36 | 18 | 523 | 15.2 | 627 | 60 | 5 | 520 | 3 | 1.5 | Example |
| 12 | 12 | 1210 | 80 | 1090 | 70 | 25 | 940 | 42 | 21 | 545 | 6.8 | 606 | 210 | 13 | — | — | — | Example |
| 13 | 13 | 1240 | 30 | 1120 | 90 | 52 | 905 | 110 | 19 | 584 | 21.2 | 663 | 500 | 7 | 520 | 5 | 0.5 | Example |
| 14 | 14 | 1260 | 50 | 1130 | 91 | 61 | 912 | 200 | 17 | 565 | 5.4 | 638 | 1000 | 8 | 530 | 3 | 3.0 | Example |
| 15 | 15 | 1280 | 120 | 1100 | 88 | 33 | 936 | 28 | 19 | 542 | — | — | — | — | — | — | 0.5 | Example |
| 16 | 16 | 1250 | 100 | 1120 | 92 | 20 | 948 | 26 | 21 | 625 | 8.5 | 669 | 120 | 1 | 520 | 2 | 2.0 | Example |
| 17 | 17 | 1270 | 30 | 1090 | 58 | 25 | 940 | 34 | 22 | 675 | 6.1 | 715 | 130 | 3 | 530 | 1 | 0.8 | Example |
| 18 | 18 | 1220 | 80 | 1120 | 80 | 50 | 888 | 36 | 16 | 635 | 9.2 | 705 | 155 | 15 | 550 | 2 | 0.5 | Example |
| 19 | 19 | 1240 | 90 | 1100 | 85 | 31 | 925 | 28 | 24 | 615 | 5.5 | 685 | 120 | 5 | 540 | 2 | 0.6 | Comparative example |
| 20 | 20 | 1230 | 60 | 1110 | 91 | 62 | 910 | 51 | 21 | 521 | — | — | — | — | — | — | — | Comparative example |
| 21 | 21 | 1220 | 60 | 1090 | 86 | 29 | 936 | 80 | 26 | 564 | 3.8 | 695 | 160 | 6 | 530 | 2 | 0.5 | Comparative example |
| 22 | 22 | 1100 | 30 | 1000 | 96 | 56 | 907 | 29 | 22 | 532 | 1.2 | 745 | 230 | 13 | 520 | 3 | 0.5 | Example |
| 23 | 23 | 1200 | 20 | 1130 | 93 | 46 | 889 | 36 | 26 | 526 | 0.7 | 689 | 80 | 3 | 530 | 1 | 0.6 | Example |
| 24 | 24 | 1220 | 30 | 1120 | 87 | 35 | 936 | 48 | 20 | 584 | 3.9 | 645 | 300 | 6 | — | — | 0.8 | Example |
| 25 | 25 | 1230 | 50 | 1130 | 68 | 21 | 945 | 27 | 14 | 593 | 17.6 | 658 | 60 | 8 | 540 | 2 | 0.4 | Example |
| 26 | 26 | 1200 | 60 | 1080 | 78 | 35 | 931 | 38 | 18 | 615 | 13.5 | 692 | 50 | 5 | 525 | 2 | 1.2 | Example |
| 27 | 27 | 1260 | 100 | 1170 | 90 | 50 | 896 | 36 | 4 | 621 | 22.1 | 736 | 90 | 12 | 535 | 1 | 1.2 | Example |
| 28 | 28 | 1240 | 120 | 1130 | 85 | 35 | 917 | 28 | 18 | 558 | 14.6 | 751 | 135 | 5 | 550 | 2 | 0.3 | Example |
| 29 | 29 | 1220 | 60 | 1150 | 40 | 0 | 972 | 24 | 16 | 542 | 8.2 | 775 | 160 | 8 | 545 | 4 | 0.2 | Example |
| 30 | 30 | 1220 | 300 | 1140 | 85 | 32 | 936 | 28 | 12 | 562 | — | — | — | — | — | — | 0.2 | Example |

*average cooling rate from finishing temperature to 750° C.
**average cooling rate from 750° C. to coiling temperature
***average heating rate from 500° C. to soaking temperature
****average cooling rate from soaking temperature to coating bath temperature

TABLE 2-2

| | | Hot rolling process | | | | | | | | | Coating annealing process | | | | | | | |
|---|---|---|---|---|---|---|---|---|---|---|---|---|---|---|---|---|---|---|
| | | Heating | | Rough rolling Finishing temperature (° C.) | Finish rolling Reduction ratio (%) | | Finishing temperature (° C.) | Cooling Cooling rate (° C./s) | | Coiling Coiling temperature (° C.) | Heating Heating temperature*** (° C./s) | Soaking | | Cooling Cooling rate**** (° C./s) | Reheating treatment Heating temperature (° C.) | | Tempering Reduction ratio (%) | |
| Steel sheet No. | Steel No. | Temperature (° C.) | Holding time (min) | | 1000° C. or lower | 950° C. or lower | | to 750° C.* | to coiling temperature** | | | Soaking temperature (° C.) | Holding time (s) | | | Holding time (s) | | Remarks |
| 31 | 31 | 1230 | 180 | 1130 | 88 | 28 | 942 | 34 | 15 | 573 | 2.8 | 685 | 125 | 12 | 535 | 2 | 0.5 | Example |
| 32 | 32 | 1230 | 120 | 1120 | 92 | 36 | 936 | 33 | 13 | 562 | — | — | — | — | — | — | 0.6 | Example |
| 33 | 33 | 1220 | 50 | 1130 | 90 | 42 | 927 | 36 | 16 | 558 | — | — | — | — | — | — | 0.2 | Example |
| 34 | 34 | 1250 | 60 | 1120 | 92 | 39 | 925 | 38 | 21 | 596 | 2.8 | 698 | 130 | 11 | — | — | 0.8 | Example |
| 35 | 35 | 1090 | 30 | 1000 | 95 | 36 | 921 | 34 | 25 | 547 | — | — | — | — | — | — | 0.6 | Comparative example |
| 36 | 36 | 1220 | 50 | 990 | 83 | 50 | 925 | 28 | 23 | 529 | 8.5 | 685 | 125 | 8 | 565 | 3 | 0.5 | Comparative example |
| 37 | 37 | 1230 | 80 | 1090 | 97 | 36 | 904 | 36 | 15 | 556 | — | — | — | — | — | — | 1.1 | Comparative example |
| 38 | 38 | 1250 | 30 | 1150 | 95 | 81 | 883 | 39 | 12 | 584 | — | — | — | — | — | — | 1.2 | Comparative example |
| 39 | 39 | 1230 | 50 | 1140 | 91 | 75 | 848 | 52 | 26 | 591 | — | — | — | — | — | — | 0.3 | Comparative example |
| 40 | 40 | 1220 | 30 | 1130 | 90 | 30 | 935 | 17 | 15 | 608 | — | — | — | — | — | — | 0.8 | Comparative example |
| 41 | 41 | 1230 | 60 | 1120 | 88 | 40 | 914 | 30 | 4 | 625 | 5.5 | 672 | 130 | 7 | 525 | 2 | 0.5 | Comparative example |
| 42 | 42 | 1250 | 50 | 1140 | 85 | 20 | 941 | 30 | 15 | 685 | — | — | — | — | — | — | 0.5 | Comparative example |
| 43 | 43 | 1230 | 40 | 1130 | 75 | 23 | 943 | 32 | 15 | 495 | — | — | — | — | — | — | 0.6 | Comparative example |
| 44 | 44 | 1240 | 80 | 1120 | 86 | 50 | 902 | 32 | 3 | 550 | 13.5 | 658 | 155 | 5 | 535 | 1 | 0.8 | Comparative example |
| 45 | 45 | 1230 | 70 | 1100 | 91 | 36 | 911 | 12 | 14 | 560 | 15.2 | 673 | 120 | 6 | 525 | 2 | 0.4 | Comparative example |
| 46 | 46 | 1210 | 60 | 1090 | 86 | 54 | 893 | 35 | 13 | 572 | 0.4 | 682 | 110 | 11 | 530 | 1 | 0.5 | Comparative example |

TABLE 2-2-continued

| | | Hot rolling process | | | | | | | | | Coating annealing process | | | | | | | |
|---|---|---|---|---|---|---|---|---|---|---|---|---|---|---|---|---|---|---|
| | | Heating | | Rough rolling | Finish rolling | | | Cooling | | | Heating | | | | Reheating treatment | | | |
| | | | | Finishing | Reduction ratio (%) | | | Cooling rate (° C./s) | | Coiling | Heating | Soaking | | Cooling | Heating | | | |
| Steel sheet No. | Steel No. | Temperature (° C.) | Holding time (min) | temperature (° C.) | 1000° C. or lower | 950° C. or lower | Finishing temperature (° C.) | to 750° C.* | to coiling temperature** | Coiling temperature (° C.) | temperature*** (° C./s) | Soaking temperature (° C.) | Holding time (s) | Cooling rate**** (° C./s) | temperature (° C.) | Holding time (s) | Tempering Reduction ratio (%) | Remarks |
| 47 | 47 | 1250 | 50 | 1120 | 84 | 61 | 901 | 41 | 15 | 549 | 0.3 | 674 | 100 | 12 | — | — | 0.5 | Comparative example |
| 48 | 48 | 1260 | 50 | 1150 | 87 | 54 | 892 | 29 | 15 | 563 | 3.3 | 778 | 125 | 5 | 525 | 3 | 0.6 | Comparative example |
| 49 | 49 | 1250 | 60 | 1130 | 92 | 25 | 936 | 30 | 14 | 582 | 5.2 | 775 | 135 | 4 | 520 | 2 | 0.8 | Comparative example |
| 50 | 50 | 1260 | 80 | 1120 | 89 | 26 | 941 | 31 | 13 | 549 | 2.4 | 666 | 1100 | 2 | — | — | 0.7 | Comparative example |
| 51 | 51 | 1250 | 90 | 1140 | 75 | 38 | 921 | 29 | 17 | 555 | 8.5 | 672 | 75 | 0.4 | 535 | 2 | 0.8 | Comparative example |

*average cooling rate from finishing temperature to 750° C.
**average cooling rate from 750° C. to coiling temperature
***average heating rate from 500° C. to soaking temperature
****average cooling rate from soaking temperature to coating bath temperature

TABLE 3-1

| | | | Microstructure | | | | | | | | | | |
|---|---|---|---|---|---|---|---|---|---|---|---|---|---|
| | | | Matrix | | | | | | | | Shape fixability | | |
| | | | | F phase | Precipitate** | | | Tensile characteristics | | | Press | | |
| Steel sheet No. | Steel No. | Sheet thickness (mm) | Type* | fraction (percent by area) | Number density ($\times 10^5/\mu m^3$) | Average grain size (nm) | Standard deviation | Yield strength YP (MPa) | Tensile strength TS (MPa) | Elon-gation El (%) | forming temperature (° C.) | Opening distance (mm) | Remarks |
| 1 | 1 | 1.4 | F | 100 | 4.1 | 3.1 | 0.4 | 1150 | 1210 | 15 | 600 | 120 | Example |
| 2 | 2 | 1.4 | F | 100 | 0.9 | 3.5 | 0.6 | 980 | 1060 | 18 | RT | 126 | Comparative example |
| 3 | 3 | 2.0 | F | 100 | 3.9 | 3.5 | 0.3 | 1120 | 1180 | 16 | 500 | 118 | Example |
| 4 | 4 | 1.4 | F | 100 | 4.2 | 2.9 | 0.3 | 1160 | 1220 | 15 | 600 | 114 | Example |
| 5 | 5 | 1.3 | F | 100 | 4.5 | 6.2 | 1.5 | 1130 | 1210 | 15 | 700 | 125 | Example |
| 6 | 6 | 1.8 | F | 100 | 3.5 | 5.6 | 1.2 | 1085 | 1150 | 16 | RT (room temperature) | 129 | Example |
| 7 | 7 | 1.6 | F + B | 98 | 2.1 | 5.4 | 1.0 | 1060 | 1110 | 17 | RT | 127 | Example |
| 8 | 8 | 1.4 | F + B | 95 | 1.0 | 3.5 | 0.6 | 1000 | 1050 | 18 | 600 | 121 | Example |
| 9 | 9 | 1.6 | F + B | 93 | 4.5 | 3.5 | 0.5 | 990 | 1150 | 16 | 650 | 120 | Comparative example |
| 10 | 10 | 1.2 | F | 100 | 4.0 | 2.5 | 0.3 | 1160 | 1230 | 14 | 700 | 116 | Example |
| 11 | 11 | 1.4 | F | 100 | 3.6 | 2.6 | 0.3 | 1140 | 1200 | 15 | 650 | 115 | Example |
| 12 | 12 | 1.6 | F + B | 99 | 3.5 | 3.2 | 0.4 | 1150 | 1220 | 15 | 700 | 118 | Example |
| 13 | 13 | 1.4 | F | 100 | 3.8 | 3.3 | 0.3 | 1140 | 1200 | 14 | 550 | 115 | Example |
| 14 | 14 | 1.8 | F | 100 | 4.1 | 3.2 | 0.3 | 1165 | 1220 | 15 | RT | 121 | Example |
| 15 | 15 | 2.0 | F | 100 | 5.2 | 2.9 | 0.2 | 1250 | 1330 | 13 | 600 | 114 | Example |
| 16 | 16 | 1.5 | F | 100 | 3.8 | 3.2 | 0.3 | 1140 | 1230 | 15 | 700 | 115 | Example |
| 17 | 17 | 1.4 | F | 100 | 2.9 | 5.1 | 0.7 | 1080 | 1170 | 16 | 700 | 122 | Example |
| 18 | 18 | 1.2 | F | 100 | 3.2 | 4.6 | 0.6 | 1100 | 1180 | 16 | 650 | 123 | Example |
| 19 | 19 | 1.4 | F + B | 93 | 2.1 | 4.5 | 0.6 | 985 | 1250 | 15 | 650 | 121 | Comparative example |
| 20 | 20 | 1.6 | F | 100 | 0.9 | 4.1 | 0.5 | 970 | 1060 | 16 | 650 | 122 | Comparative example |
| 21 | 21 | 1.2 | F | 100 | 0.8 | 6.4 | 0.8 | 960 | 1060 | 17 | 700 | 121 | Comparative example |
| 22 | 22 | 1.2 | F | 100 | 3.2 | 2.6 | 0.4 | 1120 | 1180 | 15 | 700 | 121 | Example |
| 23 | 23 | 1.2 | F | 100 | 3.3 | 2.8 | 0.5 | 1130 | 1200 | 15 | 650 | 123 | Example |
| 24 | 24 | 1.4 | F | 100 | 3.6 | 3.3 | 0.5 | 1120 | 1200 | 15 | 650 | 122 | Example |
| 25 | 25 | 1.9 | F + B | 99 | 4.1 | 3.9 | 0.4 | 1165 | 1230 | 14 | 700 | 121 | Example |
| 26 | 26 | 1.4 | F + B | 99 | 3.8 | 3.4 | 0.3 | 1150 | 1210 | 14 | 550 | 118 | Example |
| 27 | 27 | 1.7 | F | 100 | 2.9 | 3.6 | 0.4 | 1080 | 1150 | 16 | 500 | 122 | Example |
| 28 | 28 | 1.4 | F | 100 | 4.1 | 3.3 | 0.3 | 1150 | 1200 | 15 | RT | 128 | Example |
| 29 | 29 | 1.4 | F | 100 | 2.5 | 3.0 | 0.3 | 1040 | 1110 | 16 | 600 | 122 | Example |
| 30 | 30 | 1.6 | F | 100 | 3.1 | 3.1 | 0.3 | 1115 | 1180 | 15 | 650 | 121 | Example |

*F: ferrite, B: bainite

**precipitates less than 10 nm

TABLE 3-2

| | | | Microstructure | | | | | | | | | | |
|---|---|---|---|---|---|---|---|---|---|---|---|---|---|
| | | | Matrix | | | | | | | | Shape fixability | | |
| | | | | F phase | Precipitate** | | | Tensile characteristics | | | Press | | |
| Steel sheet No. | Steel No. | Sheet thickness (mm) | Type* | fraction (percent by area) | Number density ($\times 10^5/\mu m^3$) | Average grain size (nm) | Standard deviation | Yield strength YP (MPa) | Tensile strength TS (MPa) | Elon-gation El (%) | forming temperature (° C.) | Opening distance (mm) | Remarks |
| 31 | 31 | 1.6 | F + B | 99 | 3.2 | 3.3 | 0.4 | 1120 | 1190 | 15 | 650 | 119 | Example |
| 32 | 32 | 1.6 | F | 100 | 3.6 | 3.2 | 0.5 | 1110 | 1210 | 15 | 700 | 118 | Example |
| 33 | 33 | 1.2 | F | 100 | 1.5 | 3.1 | 0.3 | 1040 | 1140 | 17 | 750 | 116 | Example |
| 34 | 34 | 1.4 | F + B | 98 | 4.2 | 3.8 | 0.6 | 1170 | 1250 | 14 | 700 | 119 | Example |
| 35 | 35 | 1.8 | F | 100 | 0.9 | 6.5 | 1.4 | 980 | 1050 | 17 | 600 | 128 | Comparative example |
| 36 | 36 | 2.0 | F | 100 | 0.8 | 6.3 | 1.2 | 965 | 1060 | 17 | 650 | 125 | Comparative example |
| 37 | 37 | 1.8 | F | 100 | 1.1 | 6.3 | 1.6 | 1020 | 1080 | 16 | 600 | 136 | Comparative example |
| 38 | 38 | 1.6 | F | 100 | 1.0 | 5.5 | 1.7 | 1025 | 1100 | 16 | RT | 142 | Comparative example |
| 39 | 39 | 1.4 | F | 100 | 0.6 | 7.2 | 1.3 | 920 | 990 | 18 | RT | 130 | Comparative example |

TABLE 3-2-continued

| | | | Microstructure | | | | | | | | | | |
|---|---|---|---|---|---|---|---|---|---|---|---|---|---|
| | | | Matrix | | | | | | | | Shape fixability | | |
| | | | | F phase | Precipitate** | | | Tensile characteristics | | | Press | | |
| Steel sheet No. | Steel No. | Sheet thickness (mm) | Type* | fraction (percent by area) | Number density ($\times 10^5/\mu m^3$) | Average grain size (nm) | Standard deviation | Yield strength YP (MPa) | Tensile strength TS (MPa) | Elon-gation El (%) | forming temperature (° C.) | Opening distance (mm) | Remarks |
| 40 | 40 | 1.6 | F | 100 | 0.9 | 6.8 | 1.1 | 985 | 950 | 18 | RT | 129 | Comparative example |
| 41 | 41 | 1.6 | F | 100 | 1.0 | 5.9 | 1.6 | 1005 | 1085 | 16 | 700 | 135 | Comparative example |
| 42 | 42 | 1.4 | F | 100 | 0.9 | 7.6 | 1.3 | 955 | 1050 | 16 | 650 | 129 | Comparative example |
| 43 | 43 | 1.8 | F + B | 94 | 1.2 | 3.5 | 0.5 | 995 | 1200 | 14 | 600 | 126 | Comparative example |
| 44 | 44 | 2.0 | F | 100 | 1.1 | 5.8 | 1.7 | 1015 | 1105 | 15 | 750 | 136 | Comparative example |
| 45 | 45 | 1.8 | F | 100 | 0.8 | 6.2 | 1.3 | 960 | 1035 | 16 | 700 | 125 | Comparative example |
| 46 | 46 | 1.6 | F | 100 | 0.8 | 6.7 | 1.1 | 965 | 1040 | 16 | 600 | 128 | Comparative example |
| 47 | 47 | 1.6 | F | 100 | 0.7 | 6.8 | 1.2 | 955 | 1035 | 16 | RT | 130 | Comparative example |
| 48 | 48 | 1.4 | F | 100 | 0.5 | 7.8 | 1.1 | 855 | 960 | 18 | 650 | 123 | Comparative example |
| 49 | 49 | 1.4 | F | 100 | 0.4 | 8.1 | 1.4 | 835 | 965 | 18 | 600 | 122 | Comparative example |
| 50 | 50 | 1.4 | F | 100 | 0.8 | 7.1 | 1.2 | 950 | 1025 | 17 | RT | 126 | Comparative example |
| 51 | 51 | 1.2 | F | 100 | 0.9 | 6.2 | 0.9 | 985 | 1040 | 16 | 600 | 124 | Comparative example |

*F: ferrite, B: bainite

**precipitates less than 10 nm

All our examples are high strength steel sheets having a yield strength YP of 1,000 MPa or more and excellent shape fixability with a hat-shaped member opening distance of 130 mm or less. On the other hand, as for comparative examples, high strength steel sheets having a high strength and shape fixability in combination are not obtained, where the yield strength YP is less than 1,000 MPa and, therefore, the strength is low or the hat-shaped member opening distance is more than 130 mm and, therefore, the shape fixability is degraded.

Also, it is clear that in press forming by using our steel sheets, warm press forming, e.g., press forming after reheating to about 500° C. to 700° C. can be applied.

The invention claimed is:

1. A high strength steel sheet having:

a chemical composition comprising C: 0.08% to 0.20%, Si: 0.3% or less, Mn: 0.1% to 3.0%, P: 0.10% or less, S: 0.030% or less, Al: 0.10% or less, N: 0.010% or less, V: 0.20% to 0.80%, and the remainder composed of Fe and incidental impurities on a percent by mass basis;

a microstructure which includes 95% or more of ferrite phase on an area percentage basis, in which precipitates having a particle size of less than 10 nm are dispersed having a distribution such that the number density is $1.0\times10^{5}/\mu m^3$ or more and the standard deviation of natural logarithm values of precipitate particle sizes (nm) with respect to precipitates having a particle size of less than 10 nm is 1.5 or less; and a high yield strength of 1,100 MPa or more.

2. The high strength steel sheet according to claim 1, wherein the chemical composition further comprises at least one group selected from the following Group A to Group F on a percent by mass basis:

Group A: Ti: 0.005% to 0.20%,

Group B: at least one selected from the group consisting of Nb: 0.005% to 0.50%, Mo: 0.005% to 0.50%, Ta: 0.005% to 0.50%, and W: 0.005% to 0.50%, Group C: B: 0.0002% to 0.0050%, Group D: at least one selected from the group consisting of Cr: 0.01% to 1.0%, Ni: 0.01% to 1.0%, and Cu: 0.01% to 1.0%, Group E: Sb: 0.005% to 0.050%, and Group F: at least one selected from the group consisting of Ca: 0.0005% to 0.01% and REM: 0.0005% to 0.01%.

3. The high strength steel sheet according to claim 1, wherein a coating layer is disposed on the steel sheet surface.

* * * * *